US011683640B2

(12) United States Patent
Menendez

(10) Patent No.: US 11,683,640 B2
(45) Date of Patent: Jun. 20, 2023

(54) SPEAKER SYSTEMS WITH POLYPLANAR, NESTED, FOLDED HORNS

(71) Applicant: Mark Menendez, Savannah, GA (US)

(72) Inventor: Mark Menendez, Savannah, GA (US)

(73) Assignee: LOW COUNTRY HORNS, LLC, Savannah, GA (US)

( * ) Notice: Subject to any disclaimer, the term of this patent is extended or adjusted under 35 U.S.C. 154(b) by 0 days.

(21) Appl. No.: 17/047,345

(22) PCT Filed: Apr. 15, 2019

(86) PCT No.: PCT/US2019/027521
§ 371 (c)(1),
(2) Date: Oct. 13, 2020

(87) PCT Pub. No.: WO2019/200396
PCT Pub. Date: Oct. 17, 2019

(65) Prior Publication Data

US 2021/0120331 A1 Apr. 22, 2021

Related U.S. Application Data

(60) Provisional application No. 62/657,421, filed on Apr. 13, 2018.

(51) Int. Cl.
*H04R 1/30* (2006.01)
*G10K 11/02* (2006.01)
(Continued)

(52) U.S. Cl.
CPC ..... *H04R 1/30* (2013.01); *G10K 11/025* (2013.01); *H04R 1/02* (2013.01); *H04R 1/345* (2013.01)

(58) Field of Classification Search
CPC ..... H04R 1/30; H04R 1/347; H04R 2201/34; H04R 1/288; H04R 1/345; H04R 1/38; G10K 11/28
See application file for complete search history.

(56) References Cited

U.S. PATENT DOCUMENTS 2,872,516 A 2/1959 Hoffman
4,969,196 A 11/1990 Nakamura
(Continued)

FOREIGN PATENT DOCUMENTS

CN 101111093 A 1/2008
CN 203057452 U 7/2013
(Continued)

OTHER PUBLICATIONS

International Search Report and Written Opinion for related PCT application PCT/US2019/027521 dated Aug. 20, 2019.
(Continued)

*Primary Examiner* — Kile O Blair
(74) *Attorney, Agent, or Firm* — Bracewell LLP; Brad Y. Chin

(57) ABSTRACT

A speaker system including an enclosure, a first acoustic driver engaged with the enclosure, and two or more horns configured to output a sound from the first acoustic driver to a front plane of the enclosure. In one embodiment, the two or more horns may be folded and planar. In one embodiment, the speaker system may include a second acoustic driver, which may be installed above or below the first acoustic driver. The second acoustic driver may be larger or smaller or the same size when compared to the first acoustic driver.

52 Claims, 9 Drawing Sheets

(51) Int. Cl.
*H04R 1/02* (2006.01)
*H04R 1/34* (2006.01)

(56) References Cited

U.S. PATENT DOCUMENTS

| | | | |
|---|---|---|---|
| 5,804,774 | A | 9/1998 | Ford et al. |
| 6,516,076 | B1 | 2/2003 | Marlin |
| 8,627,920 | B2 | 1/2014 | Moore |
| 2008/0110692 | A1 | 5/2008 | Moore |
| 2008/0199032 | A1 | 8/2008 | Woelfel |
| 2015/0104054 | A1 | 4/2015 | Adams |

FOREIGN PATENT DOCUMENTS

| | | | |
|---|---|---|---|
| DE | 2701213 | A1 | 7/1978 |
| EP | 3139632 | A1 | 3/2017 |
| WO | 2012134730 | A1 | 10/2012 |
| WO | 2015184953 | A1 | 12/2015 |

OTHER PUBLICATIONS

EP19785708.9 European Search Report dated Dec. 14, 2021, 7 pgs.
CN2019800387617 First Office Action dated Oct. 9, 2022, 16 pgs.

SPEAKER SYSTEMS WITH POLYPLANAR, NESTED, FOLDED HORNS

CROSS REFERENCE TO RELATED APPLICATIONS

This application claims the benefit of and priority to PCT/US2019/027521, filed on Apr. 15, 2019, entitled "SPEAKER SYSTEMS WITH POLYPLANAR, NESTED, FOLDED HORNS," which claims the benefit of and priority to U.S. Provisional Application No. 62/657,421, filed Apr. 13, 2018, entitled "TRIPLANAR, POLYPLANAR, COMPOUND, FOLDED-HORN LOUDSPEAKER SYSTEMS," the entire contents of which are incorporated herein by reference.

TECHNICAL FIELD

This disclosure relates generally to speaker systems and sound waveform guides; and, in particular, to speaker systems such as loudspeakers, smart speakers, laptop speakers, desktop speakers, TV speakers, phone speakers, car speakers, PCs, smartphones, earphones, earbuds, and headphones.

BACKGROUND

Many techniques have been used over the years to increase the efficiency of acoustic driving elements. An early advancement was the horn loudspeaker, which uses a flared acoustic path to increase the overall efficiency of the driver. Horn loudspeakers use a shaped waveform guide in front of (or behind) the driver to transform the small diameter, high-pressure condition at the driver surface in the throat of the horn to the large diameter, low-pressure condition at the mouth of the horn. The horn can therefore be seen as an "acoustic transformer" or an acoustic lens that provides impedance matching between the driving element and the less-dense, ambient air. This increases the efficiency and directivity of the loudspeaker, focusing the sound over a narrower area in order to project it further.

Horn loudspeakers can typically produce 10 times (10 decibels (dB)) more sound power than a cone speaker at a given amplifier output. A 105 dB efficiency horn loudspeaker can exhibit a hundredfold increase in output compared to a speaker rated at 90 dB sensitivity, and is useful in applications where high sound levels are required or amplifier power is limited. Horn-loaded loudspeakers are therefore widely used in public address systems, megaphones, and sound systems for large venues like theaters, auditoriums, conferences and media rooms, and sports stadiums primarily for mid and high frequency drivers. Due to the horn directivity, they also throw sound at a greater distance than other housing shapes, and are popular for large open-air events. Profound sound pressure is also popular in clubs and dance events.

SUMMARY

Disclosed here are speaker systems including an enclosure having a back and a front defining a front plane, the enclosure adapted to engage with a first acoustic driver, and a plurality of folded horns to output the sound from the first acoustic driver to the front plane. Disclosed here are speaker systems including an enclosure having a back and a front defining a front plane, the enclosure adapted to engage with a first acoustic driver; a first folded horn within the enclosure, the first folded horn configured to output a sound from the first acoustic driver to the front plane; and a second folded horn within the enclosure, the second folded horn configured to output the sound from the first acoustic driver to the front plane. In an embodiment, the second folded horn is at least partially nested within the first folded horn. In an embodiment, a second acoustic driver is engaged with the enclosure.

The front plane of the enclosure can be flat or rectilinear. The front plane of the enclosure is curved and has one or more distinct radii. The first acoustic driver can be a low-range woofer housed in a working volume. The first acoustic driver can be a low-range woofer housed in a bowl-shaped enclosure or a configuration of nested folded horns. The first acoustic driver can be a low-range woofer housed in a cylindrical, conical, or spherical enclosure. The first acoustic driver can be a low-range woofer housed in asymmetrical or symmetrical enclosure created by a mold. The second acoustic driver can be a mid-range woofer. The second acoustic driver can be a low- or mid-range woofer housed in a rectilinear or trapezoidal volume. The second acoustic driver can be a low-range woofer housed in a bowl-shaped enclosure or a configuration of nested curved folded horns. The second acoustic driver can be a low- or mid-range woofer housed in a cylindrical, conical, or spherical enclosure. The second acoustic driver can be a low- or mid-range woofer housed in an asymmetrical or symmetrical enclosure created by a mold.

In an embodiment, the speaker system includes a first folded horn that approximates a first U shape; the second folded horn that approximates a second U shape; and the second U shape is at least partially nested within the first U shape. The first acoustic driver is a rear-firing driver aimed at a central region within the first U shape such that the output of the first acoustic driver is bifurcated between the two ends of the first U shape. The central region of a U shape can be a compression chamber. In another embodiment, the first acoustic driver is a rear-firing driver aimed at a central region within the first bowl shape such that the output of the first acoustic driver exits the system from a flared end of a bowl-shaped enclosure defined by the outer bowl and the first nested bowl. The central region of a bowl-shaped enclosure can be a compression chamber. In another embodiment, the first acoustic driver can be a rear-firing driver aimed at a central region within the first curved plate-shape such that the output of the first acoustic driver exits the system from a rectilinear opening defined by the outer curved plate and the first nested curved plate. The central region of a curved plate can be a compression chamber.

The first acoustic driver can be a rear-firing driver aimed at a radial splash plate within the enclosure which serves to distribute the output of the first acoustic driver. The first folded horn can be defined at least in part by inner surfaces of one or more walls formed within the enclosure. The second folded horn can be defined at least in part by inner surfaces of one or more walls formed within the enclosure. In certain embodiments, the first acoustic driver, the second acoustic driver, or both, are forward- or rear-firing. The speaker system can include one or more mid- and/or high-frequency drivers or tweeters. The speaker system can include at least one of a loudspeaker, a smart speaker, a laptop speaker, a desktop speaker, a speaker, earphones, earbuds, and headphones.

Also disclosed here are loudspeaker systems. In an embodiment, a loud speaker system includes a cabinet having a back and a front defining a front plane; a first enclosure in the cabinet housing a first acoustic driver forming a first folded horn; a second enclosure in the cabinet housing a second acoustic driver forming a second folded horn. The first and second folded horns have outputs aligned with the front plane of the cabinet. The front plane of the enclosure can be flat or rectilinear. The front of the enclosure can be curved and has one or more distinct radii. The first acoustic driver can be a low-range woofer housed in a rectilinear or trapezoidal volume. The first acoustic driver can be a low-range woofer housed in a cylindrical, conical, or spherical enclosure. The first acoustic driver can be a low-range woofer housed in an asymmetrical or symmetrical enclosure created by a mold. The second acoustic driver can be a mid-range woofer. The second acoustic driver can be a low- or mid-range woofer housed in a rectilinear or trapezoidal volume. The second acoustic driver can be a low- or mid-range woofer housed in a cylindrical, conical, or spherical enclosure. The second acoustic driver can be a low- or mid-range woofer housed in an asymmetrical or symmetrical enclosure created by a mold. In an embodiment of the loudspeaker system includes a first folded horn that approximates a first U shape; a second folded horn that approximates a second U shape. Here, the second U shape is at least partially nested within in first U shape. The first acoustic driver can a rear-firing driver aimed at a central region within the first U shape such that the output of the first acoustic driver is divided between the two ends of the first U shape. The first acoustic driver can be a rear-firing driver aimed at a splash plate within the enclosure which serves to bifurcate the output of the first acoustic driver. The second acoustic driver can be a rear-firing driver aimed at a central region within the second U shape such that the output of the second acoustic driver is divided between the two ends of the second U shape. The first folded horn can have configurable surfaces to approximate different waveform guide geometries. The second folded horn can have configurable surfaces to approximate different waveform guide geometries. The second enclosure can be movable within the first enclosure to vary the geometry of the second folded horn. The back of the cabinet can be vertically chambered. The first folded horn can be defined at least in part by inner surfaces of the cabinet and outer surfaces of the first enclosure. The second folded horn can be defined at least in part by inner surfaces of the first enclosure and outer surfaces of the second enclosure. In certain embodiments, the first enclosure, the second enclosure, or both, are ported. In certain embodiments, the first acoustic driver, the second acoustic driver, or both, are forward- or rear-firing. In an example, the loudspeaker system includes one or more mid- and/or high-frequency drivers or tweeters. In certain embodiments, the loudspeaker system can include one or more active or passive crossovers.

Disclosed here are sound waveform guides that include an enclosure having a back and a front defining a front plane; a first folded horn within the enclosure, the first folded horn configured to output a sound from a first source to the front plane; and a second folded horn within the enclosure, the second folded horn configured to output the sound from the first source to the front plane. The second folded horn can be at least partially nested within the first folded horn. In an embodiment, the first folded horn approximates a first U or bowl shape; the second folded horn approximates a second U or bowl shape; and the second U or bowl shape is at least partially nested within the first U or bowl shape.

BRIEF DESCRIPTION OF THE DRAWINGS

The foregoing aspects, features, and advantages of embodiments of the present disclosure will further be appreciated when considered with reference to the following description of embodiments and accompanying drawings. In describing embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

For simplicity and clarity of illustration, the drawing figures illustrate the general manner of construction, and descriptions and details of well-known features and techniques may be omitted to avoid unnecessarily obscuring the discussion of the described embodiments. Additionally, elements in the drawing figures are not necessarily drawn to scale. For example, the dimensions of some of the elements in the figures may be exaggerated relative to other elements to help improve understanding of the example embodiments. Like reference numerals refer to like elements throughout the specification.

DETAILED DESCRIPTION

Figure 1:
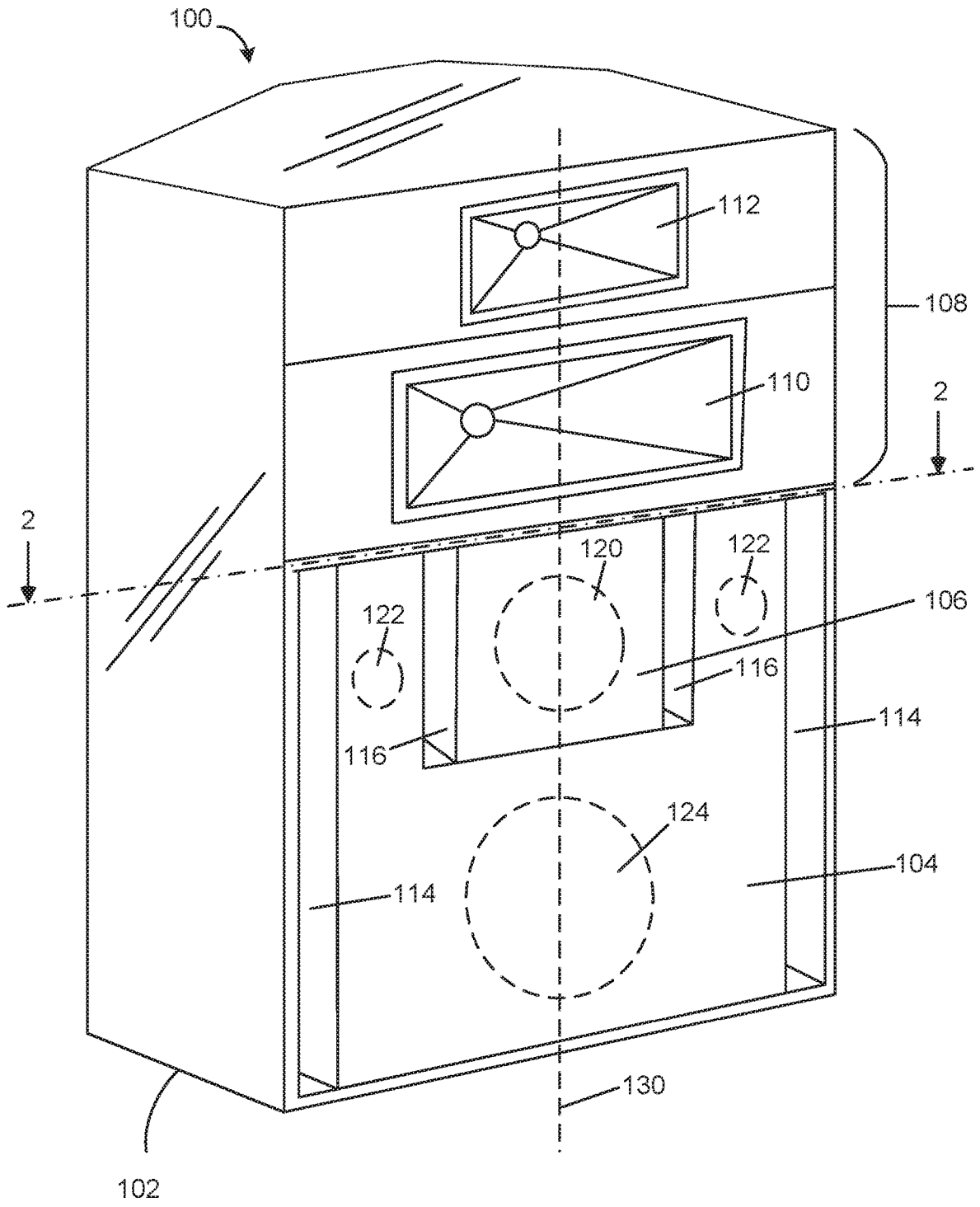
FIG. 1 is an isometric view of speaker system constructed in accordance with one or more example embodiments.

The systems of the present disclosure will now be described more fully hereinafter with reference to the accompanying drawings in which embodiments are shown. The systems of the present disclosure may be in many different forms and should not be construed as limited to the illustrated embodiments set forth herein; rather, these embodiments are provided so that this disclosure will be thorough and complete, and will fully convey its scope to those skilled in the art.

The term "speaker system" as used in this disclosure includes loudspeakers, smart speakers, laptop speakers, desktop speakers, TV speakers, phone speakers, car speakers, PCs, smartphones, earphones, earbuds, and headphones. The term "smart speakers" as used in this disclosure includes Internet-Of-Things (IoT) devices such as the Google® Home, Amazon® Echo, Apple® Homepod, Sonos® One, and the likes thereof. Smart speakers may include one or more speakers, one or more microphones, one or more cameras, and one or more processors that may be configured to communicate with the speakers, microphones, and cameras.

To function properly, the size of the horn must be tuned to the frequencies of interest. Every horn performs poorly outside its acoustic range, regardless of the center frequency. The size of the throat, mouth, the length of the horn, as well as the volumetric expansion rate along the sound waveform guide must be carefully chosen to optimize the acoustic transforming function with respect to the desired frequency range.

A basic front-loaded horn woofer/subwoofer has a closed housing with a horn directly coupled to the front of the loudspeaker. While many tweeters and mid-ranges are also constructed this way, woofers/subwoofers rarely have a front-loaded horn. Often, folded woofers fire towards the rear, experiencing a 180-degree reflection as the result of passing through a series of folds and turns, or a waveform guide, and are delivered to the front plane of the speaker. Rear-loaded horn woofers/subwoofers have speakers radiating directly to the front but with a horn directed towards the rear panel.

At high frequencies, a straight, flared horn may be readily coupled to a compression driver to conduct the sound waves to the open air. Higher frequencies work with horns only a few inches long, which is why they are often used on the tweeters and mid-ranges. To increase efficiency at lower frequencies, however, alternative techniques are more practical.

One option to increase efficiency is through the use of a 'tapped horn.' Both sides of a long-excursion, high-power driver in a tapped-horn enclosure are ported into the horn itself, with one path length long and the other short. These two paths combine in phase at the horn's mouth within the frequency range of interest. This design is especially effective at woofer/subwoofer frequencies and offers reductions in enclosure size along with more output.

Bass-reflex systems, also known as vented or ported systems, use an enclosure with a vent or opening cut into the cabinet, often with a port tube affixed to the opening. Vented or ported cabinets may also use openings to transform and transmit low-frequency energy from the rear of the speaker to the listener. Such techniques improve low-frequency output, increase efficiency, and reduce the size of the enclosure. Bass reflex designs are used in home and car stereo speakers, and cabinets for bass and keyboard amps, subwoofers and PA system cabinets.

As with other sealed enclosures, bass-reflex designs may be empty, lined or filled with damping materials or baffles. This enclosure type is very common and provides an enhanced sound pressure level near the port tuning frequency than if the same working volume were acoustically sealed, as in acoustic suspension speakers. The size of the opening and the length of the port tube are chosen so that the speaker enclosure functions as resonator, with port tuning frequency being a function of cross-section, length, working volume and driver parameters. The ports serve to capture sound pressure energy from the back wave of the driver thereby improving efficiency, particularly at lower frequencies. A higher sound pressure level can be achieved around the resonant frequency, but efficiency falls off on either side. In practice, the resonant frequency is chosen in range where the mounted speaker already exhibits roll-off or attenuation at lower frequencies. In this way, the bandwidth of the loudspeaker can be extended by approximately one octave.

To achieve adequate response at bass frequencies, the physical size of the horn must be scaled up, which is why straight, uniaxial horns are more often used for midrange and higher frequencies. The lower the frequency, the larger the horn. The design of practical, portable bass horns has always challenged audio engineers, because low frequency wavelengths require a long horn. Indeed, the length and cross-sectional mouth area required to create a bass or sub-bass horn requires a horn that is many feet long. A horn tuned for a subwoofer at 17 Hz for example, would ideally be about 25 feet long.

The challenge to reduce the horn's dimensions without decreasing its length naturally leads to a technique that involves "folding" the horn. This approach collapses the physical dimensions of the horn without reducing its length by physically folding the horn within a cabinet. A folded-horn uses a labyrinthine path to lengthen the waveform guide. For example, a woofer driver may be mounted in a loudspeaker enclosure divided by internal partitions or baffles to form a zigzag duct with an increasing flare that functions as the folded horn.

Acoustic horns may be folded in many different ways to reduce housing size to acceptable dimensions. Folded horns can reduce the total size, but compel designers to make compromises and accept increased complication in terms of cost and construction. The horn shape may be mathematically defined; for example, with exponential flaring at bass frequencies. At the same time, the crossover frequency, an important consideration in all horn configurations, depends on the size of the horn opening.

Loudspeaker manufacturers make use of various combinations of the above types of design considerations. Additionally, there is much focus on the electromagnetic components, or drivers, the crossover networks which feed and split the line level signal, time-alignment considerations, phasing, and more. It is well understood that, in general, a larger loudspeaker enclosure, or cabinet, will reproduce lower frequencies more effectively than a small loudspeaker enclosure. Clearly this is true of all types of acoustic instruments also. Larger string instruments have larger bodies and lower tones because they have longer strings. Larger woodwinds have lower tones because of the larger size of the column of air which they contain. Brass instruments show that a larger horn, like a tuba, will sound a deeper tone than a smaller brass horn, like a trumpet.

Because it requires large volumes for woofer drivers to reach the lowest audible frequencies, most of the design considerations of a loudspeaker are impacted by the cabinet construction. In order to reduce size requirements many will try to make use both of the front wave from the driver and at the same time will seek to harness at least some of the sound pressure from the back wave of a woofer, which occurs inside of the working volume for that driver.

Additionally, many modern speaker systems contain an embedded real-time analyzer (RTA), which continuously provides signal correction to compensate for room effects. Room effects receive more attention currently than the interior architecture of the loudspeaker itself. Just as instruments evolved over long periods of time and underwent much experimentation with various embodiments, similarly, loudspeakers show an incredible diversity in their construction and design.

A loudspeaker must sound like any and all instruments, so it follows that one should view the construction and design similar to making an instrument. Since a loudspeaker cannot be both big and small at the same time, it seems reasonable to make a loudspeaker with a series of nested waveform guides all within the same enclosure which can each preferentially reproduce frequencies particularly well suited acoustically to their shape and size. Disclosed here are enclosures that present a plurality of successively smaller shells for folding a number of rear firing woofers. An outer shell defines the overall boundaries of the loudspeaker enclosure or cabinet. When a slightly smaller shell, or a working volume for the dedicated driver, of a similar shape is nested inside of the outer shell, then a second waveform guide is created within the outer waveform guide and each will resonate at different wavelengths and octaves simply due to their relative size. At the same time, an axial arrangement can be maintained which enhances signal coherence and time alignment.

Example embodiments disclosed improve upon the prior art designs by providing speaker systems wherein two or more folded horns share enclosure surfaces in nested configurations for one or more of enhanced efficiency, wide dynamic range, relative compactness, overall flatter frequency response, greater lateral dispersion, and improved tuning due to the steep response gradients afforded by an extremely efficient enclosure. The folded horns can be a single continuous structure or multiple segmented structures arranged to form a shape. For example, the folded horn can be a continuous structure to form a bowl shape or it can be a set of segmented structures, such as nested curved plates, to form a segmented bowl shape. In certain embodiments, the folded horns are structured to affect the acoustic impedance by guiding sound waves from a larger opening or compression chamber to smaller openings or chambers.

The most basic embodiment involves U-shaped shells made of plywood cabinet construction. A large outer U-shaped cabinet waveform guide can receive fully or partially, a second smaller shell within its boundaries which is parallel to the outer shell in a non-Euclidean way.

Accordingly, one example embodiment is a speaker system including an enclosure, having a back and a front defining a front plane and adapted to engage with a first acoustic driver in a working volume which fits into the outer shell leaving only narrow apertures for the release of the sound pressure from two opposing sides of the front plane of the loudspeaker waveform guide if the driver is rear-firing, and creates a first U-shaped folded horn waveform guide formed within the enclosure when its working volume is slid into the outer shell. The first rear-firing folded horn is configured to output a sound from the first acoustic driver to the front plane after undergoing bifurcation and a 180 degree reflection off of the back of the outermost shell. The system further includes a second folded horn waveform guide formed within the enclosure. The second folded horn is configured to output the sound from the second rear-firing acoustic driver to the front plane in the same way. The acoustic drivers engage with the enclosure or a folded horn through chemically or physically fastening mechanisms or some type of stand-off. For example, the acoustic driver may be integrated with the enclosure or a folded horn or the acoustic driver may engage with the enclosure or a folded horn via a physical installation, such as screws, bolts, slots, etc. In one embodiment, the second folded horn is at least partially nested within the first folded horn. The second acoustic driver may be larger or smaller or the same size as the first acoustic driver. More than one driver can be mounted within any given shell which is(are) suitable for reproducing the desired octaves. The speaker system may include at least one of a loudspeaker, a smart speaker, a laptop speaker, a desktop speaker, a TV speaker, phone speaker, car speaker, PC or smartphone speaker, earphones, earbuds, and headphones.

Another example embodiment is a loudspeaker system including a cabinet having a back and a front defining a front plane, a first enclosure in the cabinet housing a first acoustic driver forming a first folded horn, and a second enclosure in the cabinet housing a second acoustic driver forming a second folded horn. The first and second folded horns may be configured to have outputs aligned with the front plane of the cabinet. In one example embodiment, a low-frequency bass driver is disposed in a first enclosure forming a first folded horn configuration. A mid-range bass driver, disposed in a second enclosure, is at least partially disposed in a cavity formed in the first enclosure, thereby forming a second folded horn configuration.

In one example embodiment, the first folded horn defines a first U- or horseshoe-shape, and the second folded horn defines a second U- or horseshoe-shape received by the first U- or horseshoe-shape. The ends of the two shapes direct acoustic energy across a common plane as they exit the front of the enclosure. Orthogonal to the exit plane, the two pairs of parallel slotted openings each create a distinct orthogonal non-Euclidean plane which wraps around a central axis. Because the rear firing wave has been bifurcated, each pair of slotted openings actually corresponds to a single distinct non-Euclidean plane. Mid and high-frequency drivers or tweeters may be oriented from the central axis to emit from the same forward-firing direction, resulting in a tri-planar structure. The addition of symmetrically placed ports then creates a poly-planar configuration.

Embodiments include nested successive shells or bowls which create a condition containing multiple waveform guides. The working volume of each driver is placed within either a shell of its own or a shell formed by its working volume and a common boundary of a larger waveform guide, like a sea shell within a sea shell, a small horseshoe inside of a larger horseshoe, or like a series of nested bowls, or a series of successively smaller plates, or acoustic fins, each sitting on top of a smaller plate or acoustic fin.

In a typical embodiment, the width and depth of the U-shaped waveform guide can be altered varying the effective length of the U-shaped waveform guide that is created upon nesting a second smaller enclosure. The degree to which the second shell is nested in an encompassing outer shell will expand or constrict the exiting sound waves from the outer folded shell. The longer the effective length of the U-shaped waveform guide, the lower are the octaves it will produce without significant acoustic decay. Given specific overall dimensions, the smaller nested shells can be sized to target higher octaves and can be tuned acoustically to provide a very flat frequency response from the lowest frequency created by the largest waveform guide up to the highest frequencies of the audible spectrum.

In one example embodiment, the first folded horn defines a first bowl shape, and the second folded horn defines a second bowl shape received by the first bowl shape. The radial edges of the two bowl shapes direct acoustic energy across a common plane as they exit the front of the enclosure. Orthogonal to the exit plane, the pair of annular openings creates a distinct orthogonal non-Euclidean plane which wraps around a central axis. Mid and high-frequency drivers or tweeters may be oriented from the central axis to emit from the same forward-firing direction, resulting in a tri-planar structure. The addition successively nested bowl-shaped enclosures create a tri-planar or poly-planar configuration. The U-shaped waveform guide can be stretched vertically or horizontally to give a cabinet which is either short and wide or a cabinet which is tall and narrow. In each case, the goal is to create a series of nested waveform guides which is capable of long overall path lengths (relative to overall size) for the columns of air contained in a uniform cross-section of the structure. In the same way as with the U-shaped waveform guides, the bowl-shaped enclosures can also be successively nested, symmetrically, one within another. A typical cross-section of the symmetrically bifurcated U-shaped waveform guides can be rotated 360 degrees around its axis of symmetry to generate a radial embodiment.

A radial embodiment can also be tuned by varying size and shape. The bowl can be deep or shallow, narrow or wide. A flattened-out radial embodiment can be spherical in or partially rectilinear in its profile and in the shape of the non-Euclidean exit from the enclosure, as can be a bowl-shaped enclosure. In other words, the front plane can be circular, conical, recti-linear, or any other symmetrical or asymmetrical shape. For example, the waveform guides can take the shape of a square bowl or a round plates, or vice versa.

In one example embodiment, the first folded horn defines a first curved plate shape which comes to 4 corners, and the second folded horn defines a second curved plate shape received by the first curved plate shape. The rectilinear edges of the two curved plate shapes direct acoustic energy across a common plane as they exit the front of the enclosure. Orthogonal to the exit plane, the pair of openings creates a distinct orthogonal non-Euclidean plane which wraps around a central axis. Mid and high-frequency drivers or tweeters may be oriented from the central axis to emit from the same forward-firing direction, resulting in a tri-planar or poly-planar structure. The addition of successively nested plates, or acoustic fins, creates a tri-planar or poly-planar configuration again.

The speaker system is highly configurable and adjustable in that the second mid-range bass driver box in a recti-linear arrangement may be translatable from front to back, thereby tuning the throat of the second folded horn. Similarly, nested bowl-shaped enclosures can translate forward or backward in relation to one another just as the nested U-shaped shells can also translate in relation to one another to afford a tuning parameter in design and construction. In fact, the acoustic fins of any arrangement can be manufactured differently or provided to the end user with the ability to adjust these parameters. Further, while in one example embodiment the folded-horn drivers are rear-firing and the separate enclosures are unported, the drivers may forward firing appearing in the rear of the acoustic lens, and ports may be provided to create different loading combinations, horn tapping and bass reflex possibilities.

Active and/or passive crossovers may be used and/or adjusted in conjunction with these physical tuning capabilities to match acoustic performance to numerous indoor and outdoor environments. The various embodiments are also scalable, finding utility in a wide variety of applications ranging from hearing aids and vehicular installations to stadiums and festival use.

Another example embodiment is a sound waveform guide including an enclosure having a back and a front defining a front plane, a first folded horn within the enclosure, the first folded horn configured to output a sound from a first source to the front plane, and a second folded horn within the enclosure, the second folded horn configured to output the sound from the first source to the front plane. In one embodiment, the second folded horn may be at least partially nested within the first folded horn. In one embodiment, the first folded horn approximates a first U shape, the second folded horn approximates a second U shape, and the second U shape is at least partially nested within the first U. In another embodiment, the first folded horn approximates a first bowl shape, the second folded horn approximates a second bowl shape, and the second bowl-shaped horn is at least partially nested within the first bowl shape FIG. 1 is an isometric view of a loudspeaker system 100 constructed in accordance with one or more example embodiments. The system comprises an overall outer shell or enclosure 102 integrating a first housing working volume or box 104 associated with a low bass driver, and a second box 106 associated with a mid-bass driver. The box which serves as the working volume for the first low bass driver is notched to receive a second box which is loaded with a second mid-bass driver. The system includes and upper portion 108 for inclusion of higher-frequency drivers, such as horns 110, 112, though conical tweeters or other types of mid-range and high frequency drivers may be substituted, including arrays of mixed drivers, depending upon the desired frequency response. The midrange and tweeters in this configuration are oriented in an axis central to the overall enclosure indicated by line 402 so that the pair of U-shaped bifurcated folds from the two nested woofers are symmetrically positioned on either side of the central axis containing the midranges and tweeters creating the tri-planar arrangement in FIG. 6. If any nested box or working volume has ports installed in them, then the ports will also be oriented symmetrically around the central axis containing the midranges and tweeters creating a poly-planar embodiment. If any nested box or working volume has additional nested structures installed or embedded in them, then the successive waveform guides will also be oriented symmetrically around the central axis containing the midranges and tweeters creating a poly-planar embodiment.

In one example embodiment, the low bass driver box 104 is assembled apart from the sidewalls of the overall enclosure so as to form a first folded-horn structure. In particular, as described in further detail herein below, the configuration results in a first horseshoe or U-shaped waveform guide, wherein the ends of the U form vertical slots 114 parallel to the front plane of the enclosure 102. The rear-firing low bass woofer fires into the compression chamber in the rear of the speaker and directly towards a splash plate that bifurcates the wave into two halves each of which exits the enclosure on opposite sides of the front plane (not visible in FIG. 1) with the mouth of the horn being formed by two vertical slots 114. The waveform guide of the horn, formed by the compression chamber, a bifurcating reflector and other elements described below, determines the geometry of the folded acoustic path, which may be engineered to approximate different horn profiles and lengths, including parabolic, hyperbolic, conical, exponential and stepped. The compression chamber serves to correct the impedance mis-match between the driver and the air. The U-shaped acoustic path provides a vibrating column of air that fills the U-shape. The vibrating column of air resonates like an open-ended organ pipe. Changing the size of the overall enclosure will change the folded woofer path length and thereby the lowest resonant frequency emitted from the vibrating columns of air captured by each U-shape fold. The compression chamber combined with the path length create a low pass filter in the outermost U-shaped waveform guide. The cutoff frequency at the upper end of the woofer's frequency response range will be dependent on the size and particular geometry. Any nested waveform guide will be restricted on the low end of its frequency response spectrum and will create a bandpass filter for the acoustic signals produced by the smaller, nested woofers employed in successively nested shells.

Continuing the reference to FIG. 1, first box 104 includes an upper cavity or cut-out configured to receive a second box 106 that houses a mid-bass or bass driver. This driver can also rear-firing into a second folded-horn structure, the mouth of which is formed by a second set of vertical slots 116. As with the first folded-horn structure, the second mid-bass driver fires into compression chamber in the rear of the second, nested U shape fold and directly towards a splash plate that bifurcates the sound wave into two halves each of which exits the enclosure on opposite sides of the central vertical axis of the front plane. Again, these surfaces may approximate any of the horn profiles listed above. In one embodiment, the second box 106 may slide in and out on a dovetail guide, for example, enabling the listener to adjust the profile of the second folded horn following manufacture.

Thus, with the second box 106 being received within a cut-out or cavity formed with the first box 104, a nested folded-horn arrangement is created wherein a second bass or mid-bass driver is couched partially or entirely within the folded enclosure for the first woofer. Further, with the mid-range, bass, and tweeter(s) being arranged symmetrically on central axis 130, a tri-planar or poly-planar configuration can be achieved.

Various modifications may be made to the system described here without departing from the scope or spirit of this disclosure. For example, while the second box is shown within an upper cut-out in the first box, the cut-out may in the center or lower portion of the first box so long as on-axis symmetry is preferably maintained. One or both of the bass drivers may be forward driving as opposed to rear-driving, as depicted by the broken line outlines 120, 124. In such configurations, the back wave from front-firing woofers can be passed through the nested waveform guide and analogous respective folds. Alternatively, a front-firing driver could be employed behind the acoustic lens formed by the nested waveform guide. Other internal ports 122, taps, or perforations can further tune the apparatus by varying the degree of acoustic coupling between successive acoustic fins, whether they are rectilinear, radial, bowl, plate, bowl or otherwise, and some or all of the front of the enclosure may be covered with grill cloth, as desired.

In terms of panel construction, attention is given to maximize stiffness and density while minimizing weight and cost. Wood and/or composites may be used to reduce distortion, particularly since, in the example embodiments, pressure waves are shared by internal walls of each folded horn over into the adjacent folded horn spaces, which can otherwise reduce the pressure of the sound wave on one side of the panel while increasing it on the other. To avoid muddy or boomy vibrations, multicore, void-free, hardwood-based plywoods are preferably used throughout, though solid, even reclaimed hardwoods may be used for visible panels to enhance appearance. Internal corner edges are preferably filleted to smooth transitions between sections of the folded acoustic paths.

Figure 2:
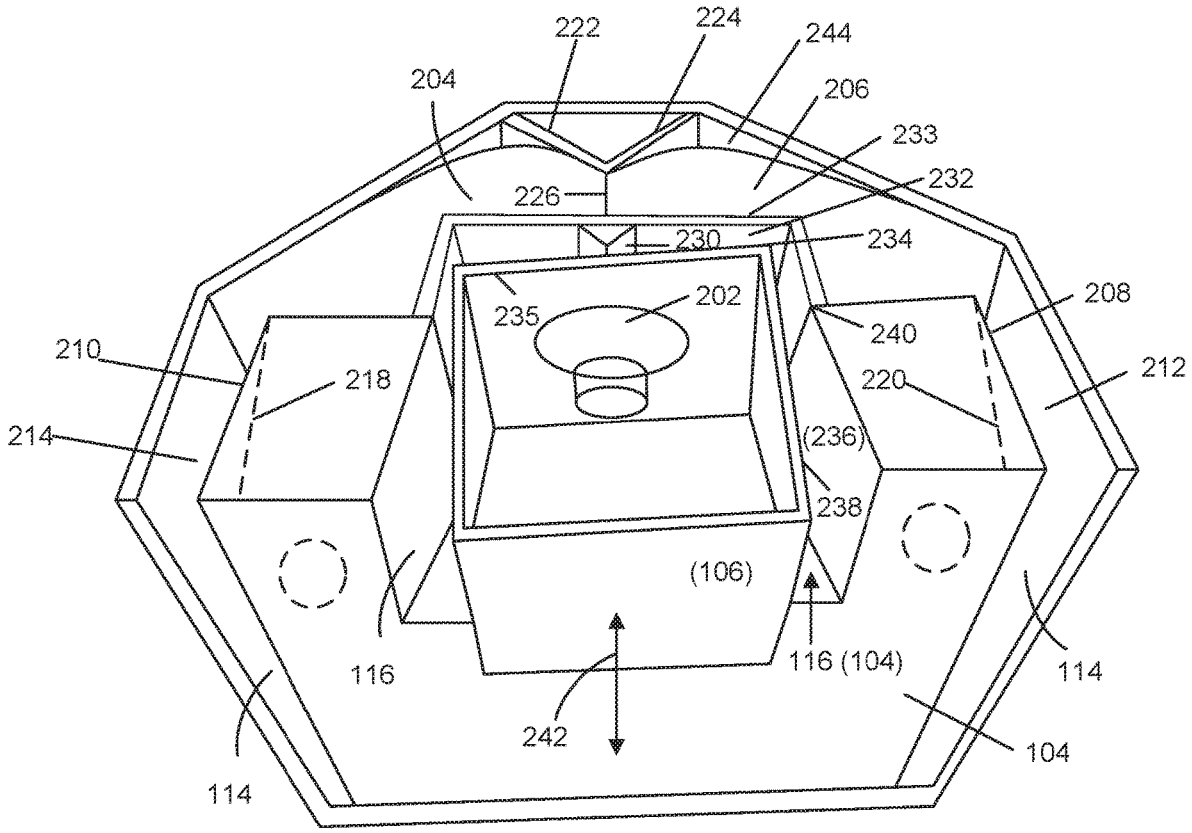
FIG. 2 is a cross-sectional view of the speaker system shown in FIG. 1 along line 2-2, according to one or more example embodiments.

FIG. 2 is a cross-sectional view of the loudspeaker system 100 shown in FIG. 1 along line 2-2. The system has a nested folded-horn low- and mid-bass woofers with upper cabinetry removed to show baffle details. A rear-firing first bass driver, situated directly below mid-bass driver 202, not visible in this illustration, fires into the large compression chamber defined by the outer shell and the nested working volume of the large bass woofer. The output of the first acoustic driver strikes a spline-type divider composed of curved panels 204, 206, bifurcating the sound to vertical mouth 114 ports formed by the outer walls 208, 210 of the first box 104 and the inner walls 212, 214 of the outer enclosure 102. While these surfaces may be parallel to one another, they may also be angled as shown by broken lines 218, 220 to open the mouth of the first folded horn.

The structure described for the first folded horn is therefore compound and complex, combining a gradually increasing geometric waveform guide formed by curved panels 204, 206 with a stepped transition to flares 114. All aspects of these paths may be customized, with the curved panels in particular being shaped to approximate parabolic, hyperbolic, tractrix, tapered, conical or exponential geometries. Supports 222, 224 may be configured to adjust the front-back placement of sound bifurcating edge in conjunction with the desired profile of the folded path.

Continuing the reference to FIG. 2, second enclosure 106 supports a mid-range bass driver 202 which may be front-driving or rear driving as shown. In this embodiment, acoustic energy from driver 202 strikes sound divider 230, forming a second folded horn that uses the front wall 232 of panel 233 and back wall 234 of panel 235. The path continues on to mouth opening 116 through a flared area that uses the side surfaces of panels 236, 238. In one example embodiment, the flare widens at edge 240 to improve acoustic coupling as a function of the desired frequency range. Second box 106 may slide back and forth as shown by arrow 242 using a dovetail groove or other mechanism, enabling a user to adjust the geometry of the second folded horn to improve impedance matching for a given listening environment.

In FIG. 2, batting or sound-dampening materials may be provided in dead spaces such as 244 as desired. Also, not shown in the drawing, inside corners may include integral fillets to add strength and smooth sound transitions from one chamber to another.

Figure 3:
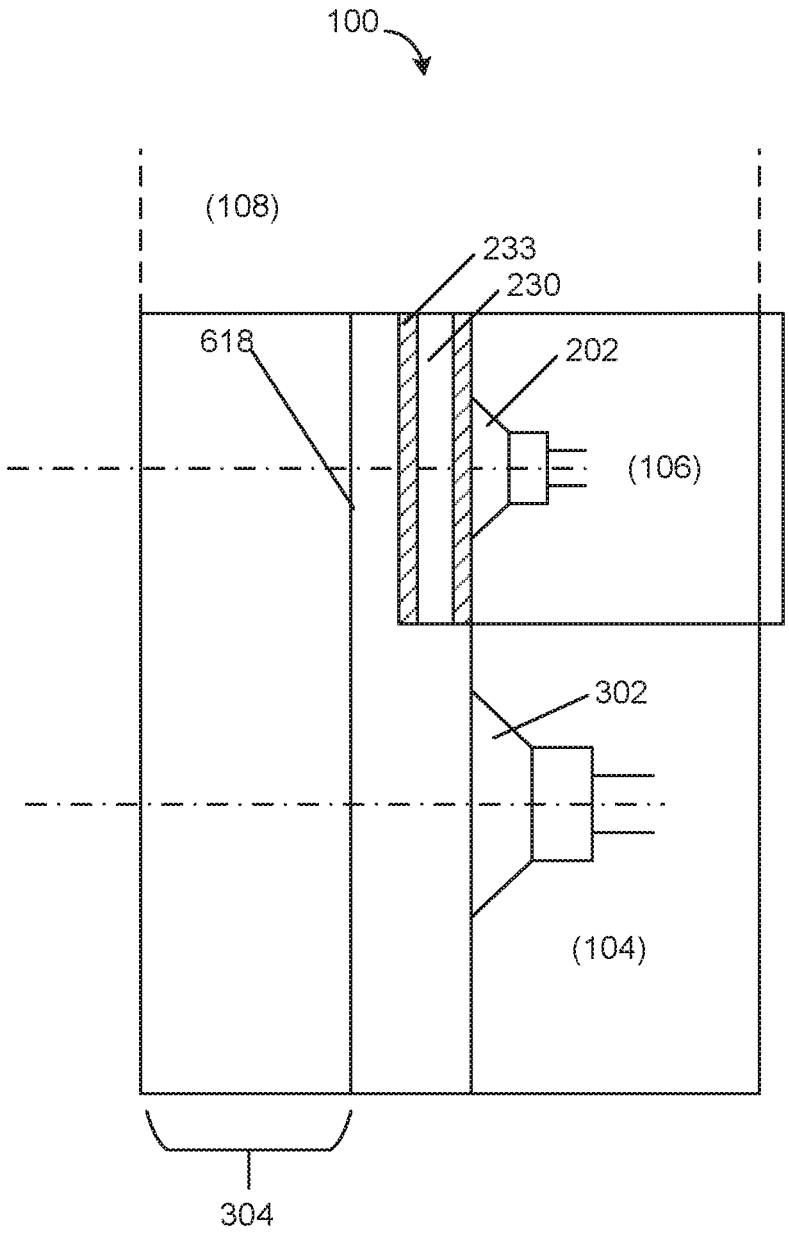
FIG. 3 is a simplified vertical cross-sectional view of a speaker system, according to one or more example embodiments.

FIG. 3 is a simplified vertical cross section showing both boxes 104 and 106, and both respective drivers 302, 202. Reference 304 indicates the back portion of the cabinet that is preferably angled at 45 degrees from the sides and rear. Note that the fixed 45 degree is arbitrary for ease of construction, but the waveform guide can still experience two degrees of freedom given in the ratio of the length to the width (see FIG. 7A). In general, these are the two independent variables which determine overall path length of the waveform guide. The region called out as 108 represent that portion of the cabinet consumed by tweeters or higher-frequency drivers. The midranges and tweeters may be integral to the overall structure or they can be constructed and attached as a separate module, as you would stack horns on bass boxes for concert applications. Many of the dimensions are variable, including the spacing between the axes of the drivers 202, 302. Driver size may also be varied. For example, deep bass driver 302 may be in the range of 8 to 15 inches, more or less, whereas woofer may be 6 to 12 inches, more or less. Linear and other arrays of smaller drivers may also be used in place of single units.

Figure 4:
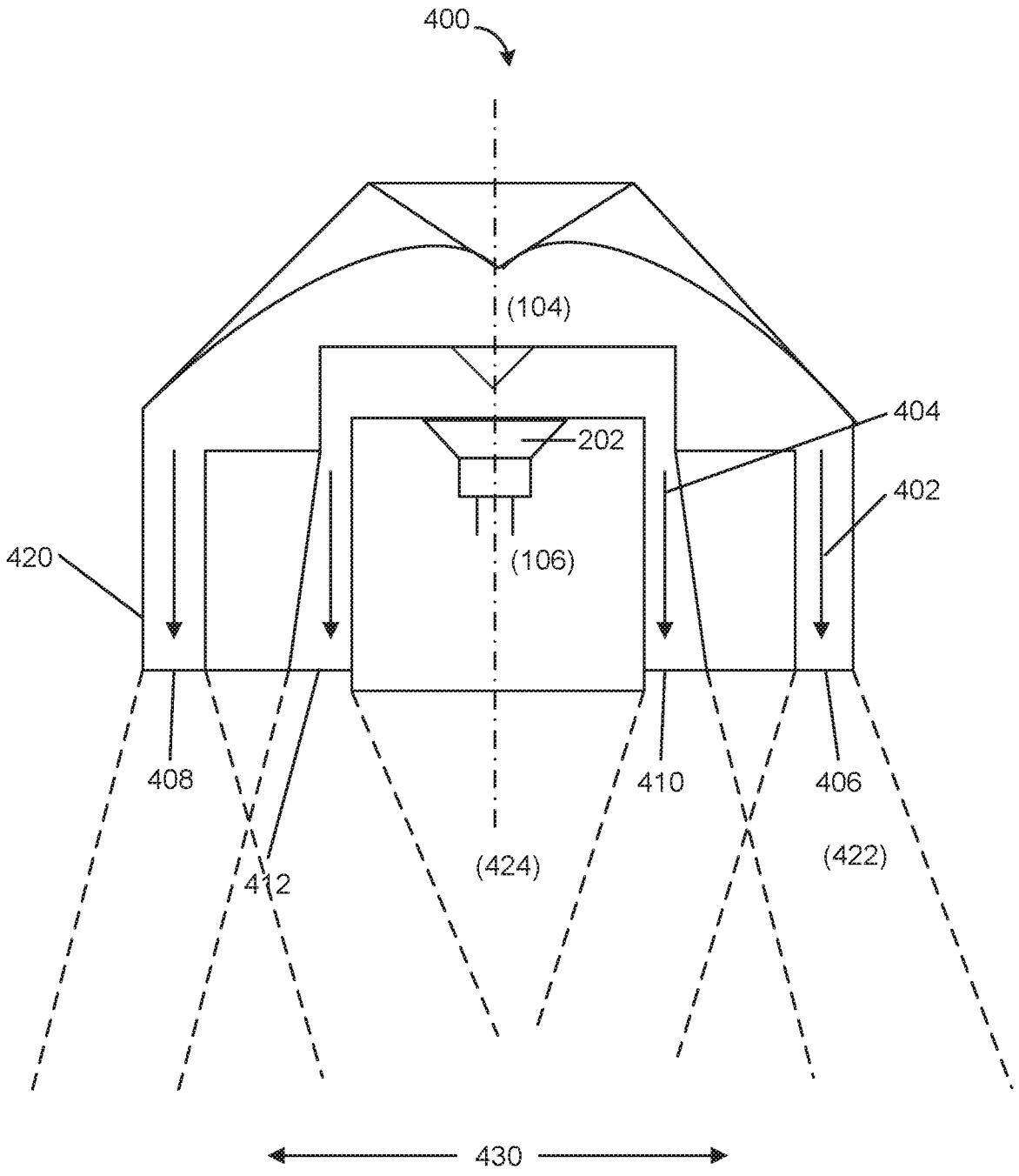
FIG. 4 is a simplified, top-down rendering of a speaker system including multiple, nested horseshoe or U-shaped folded horns, with the "ends" of the U-shapes being generally orthogonally planar to the front of the speaker system, according to one or more example embodiments.

FIG. 4 is a simplified, top-down rendering of a speaker system 400 with multiple, nested horseshoe or U-shaped folded horns 402, 404, with the "ends" of the U-shapes 406, 408 and 410, 412 being generally planar to the front of the cabinet 420. This structure, in conjunction with complementary high-frequency drivers or tweeters, results in a tri-planar or poly-planar design that dramatically improves lateral dispersion and particularly the efficiency of the lowest octaves in the audible spectrum, as shown by the compression envelopes 422. While these envelopes are representative only, and subject to multiple design considerations, the system minimizes dead zones 424 and increases listening area 430, which exhibits a high coherence and improved bass response.

Figure 5A:
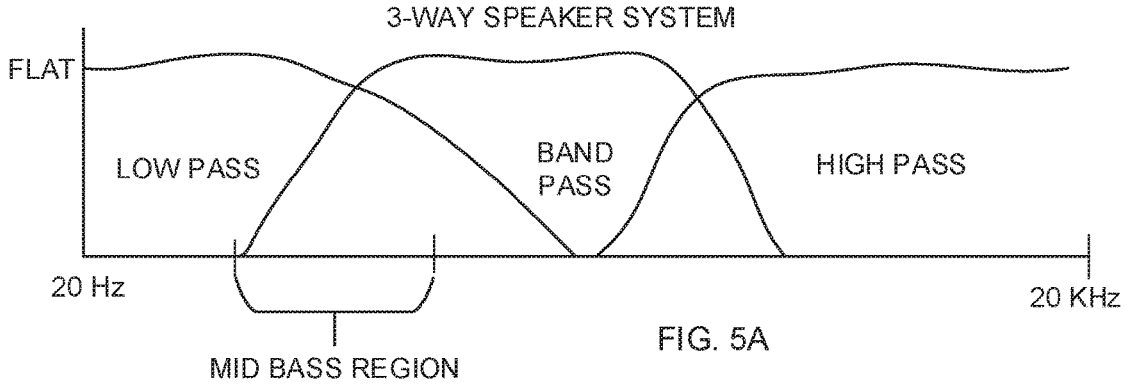
FIG. 5A is an illustration of a frequency response curves for a 3-way speaker system, according to one or more example embodiments.
Figure 5B:
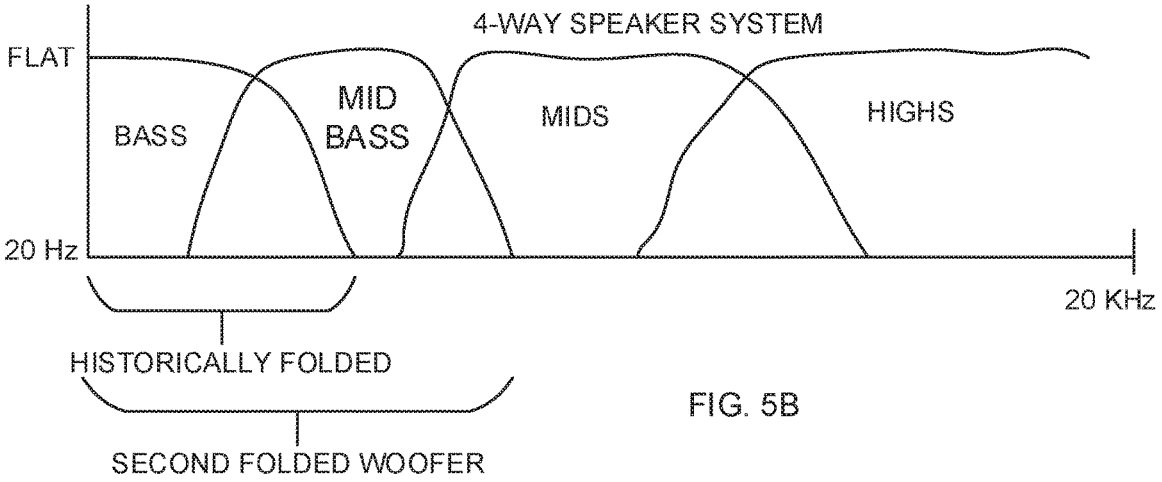
FIG. 5B is an illustration of a frequency response curves for a 4-way speaker system, according to one or more example embodiments.
Figure 5C:
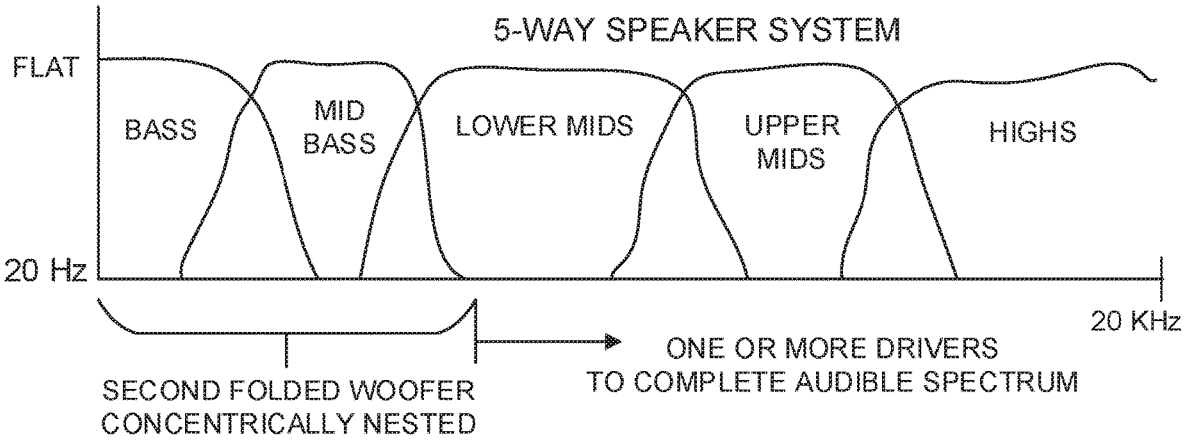
FIG. 5C is an illustration of a frequency response curves for a 5-way speaker system, according to one or more example embodiments.

FIGS. 5A-C are frequency response diagrams applicable to one or more example embodiments. In each case, the bottom axis runs from approximately 20 Hz to 20 kHz. The top diagram, FIG. 5A, illustrates the aggregate response for a 3-way speaker system, calling out the overlap associated with the mid-bass region. FIG. 5B depicts the response curve of a 4-way speaker system, showing how the combination of double folded horns results in a flat response from deep through mid-bass. FIG. 5C is similar to FIG. 5B in the bass region, with the addition of three higher-frequency drivers completing the audible spectrum for a substantially flattened 5-way speaker system response.

Figure 6:
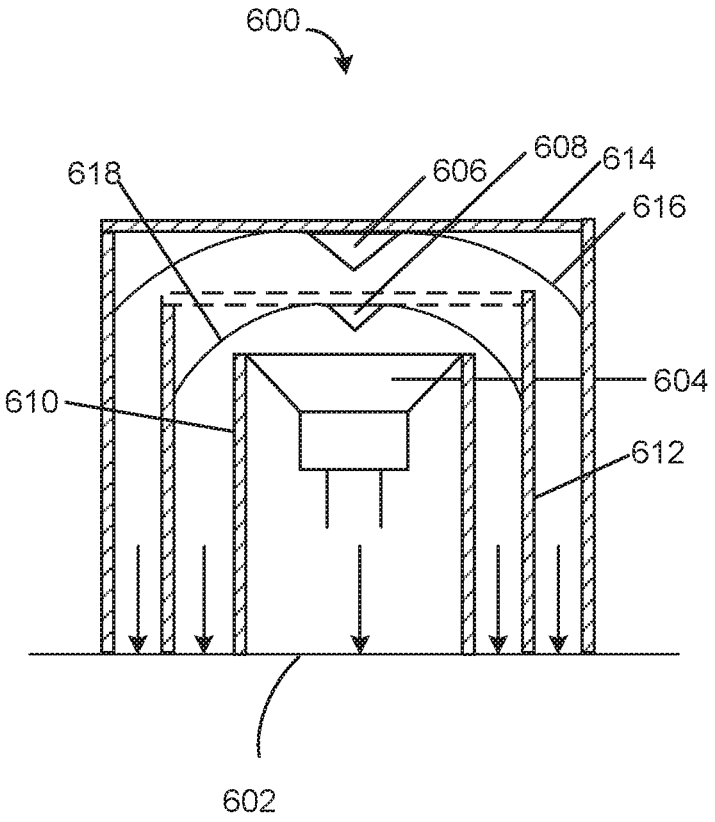
FIG. 6 is an illustration of a simplified, top-down rendering of a speaker system including multiple, nested horseshoe or U-shaped folded horns, with the "ends" of the U-shapes being generally orthogonally planar to the front of the speaker system, according to one or more example embodiments.

FIG. 6 is a simplified, top-down rendering of a speaker system 600 including multiple, nested horseshoe or U-shaped folded horns, with the "ends" of the U-shapes being generally orthogonally planar to the front 602 of the speaker system 600. The speaker system 600 may include an enclosure 614 having a back and a front defining a front plane 602. The system 600 may include a first acoustic driver 604 engaged with the enclosure 614. The system may further include a first folded horn formed at least partially by surfaces of walls 610, 612 within the enclosure 614. The first folded horn may be configured to output a sound from the first acoustic driver 604 to the front plane 602. The system may also include a second folded horn formed at least partially by surfaces of the walls 612, 614. The second folded horn may also be configured to output the sound from the first acoustic driver to the front plane 602. In this embodiment, the first folded horn is at least partially nested within the second folded horn.

The speaker system 600 may further include one or more spline-type dividers composed of curved panels 616, 618, bifurcating the sound to vertical mouth ports formed by the walls 610, 612 of the enclosure 614. While these surfaces may be parallel to one another, they may also be angled to open the mouth of the folded horns. The speaker system 600 may also include sound dividers 606, 608, which may be used to direct acoustic energy from driver 604 as they strike the sound dividers 606, 608.

Figure 7A:
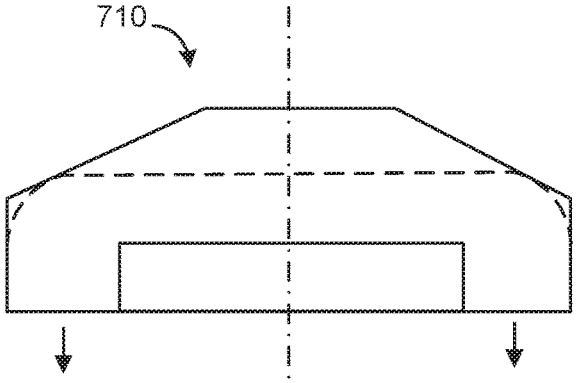
FIG. 7A is an illustration of a generalized U-shape contained in and formed by a radial embodiment, according to one or more example embodiments.
Figure 7B:
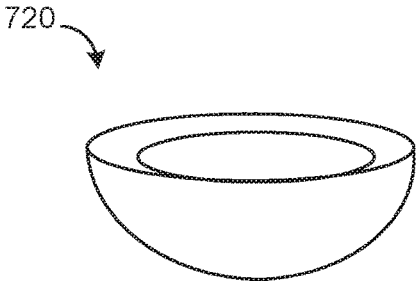
FIG. 7B is an illustration of a bowl-shaped radial embodiment generated by spinning the generalized U-shape of FIG. 7A around its axis of symmetry, according to one or more example embodiments.
Figure 8A:
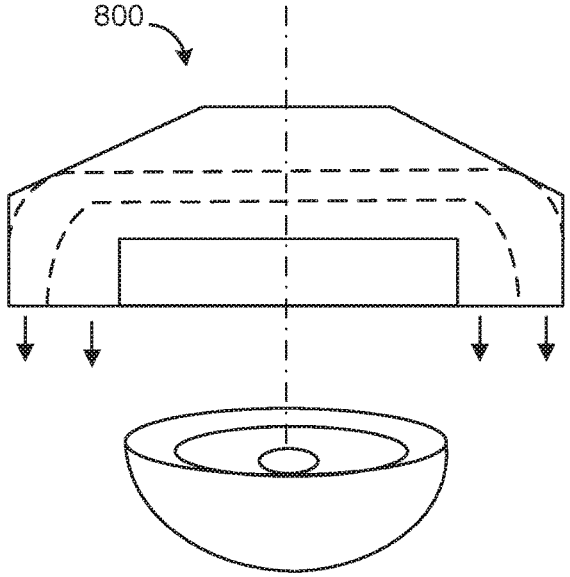
FIG. 8A is an illustration of a radial embodiment of a speaker system including multiple, nested bowl-shaped waveform guides creating an acoustic lens composed of nested bowl-shaped folded waveform guides which all can be loaded with one or more drivers, with the "ends" of the bowl-shapes being generally orthogonally planar to the front of the speaker system, according to one or more example embodiments.

FIG. 7A is an illustration of a generalized U-shape contained in and formed by a radial embodiment. FIG. 7A illustrates a cross-sectional U shape 710 which when rotated 360 degrees generates a radial embodiment 720. This radial embodiment 720 can be a single continuous structure, which when rotated around a central axis generates a bowl-shaped horn as shown in FIGS. 7B and 8A. FIG. 7B is an illustration of a bowl-shaped radial embodiment generated by spinning the generalized U-shape of FIG. 7A around its axis of symmetry, according to one or more example embodiments. The radial embodiments can be segmented structures that are arranged in a nested petal fashion to form a succession, or a plurality, of folded waveform guides or acoustic fins.

Figure 7C:
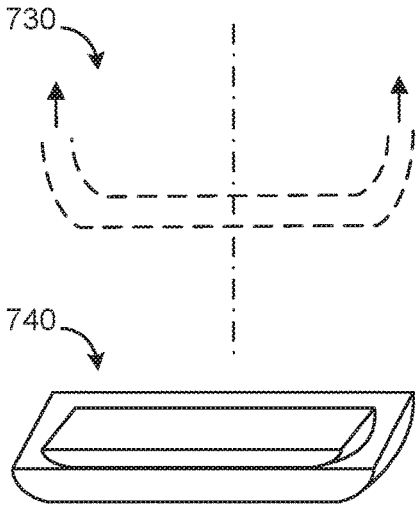
FIG. 7C is an illustration of a cross-sectional U shape of a rectilinear embodiment, also referred to as an acoustic fin, that is then rotated around its central axis to create the rectilinear three-dimensional embodiment, according to one or more example embodiments.

FIG. 7C is an illustration of a cross-sectional U shape of a rectilinear embodiment, also referred to as an acoustic fin, that is then rotated around its central axis to create the rectilinear three-dimensional embodiment. FIG. 7C illustrates a curved plate shaped embodiment 730 with a square perimeter. The curved plate embodiments can be segmented structures that are arranged in a nested petal fashion completely analogous to a nesting of bowls 740 to form a succession, or a plurality, of curved plates or acoustic fins which form nested folded waveform guides.

Figure 7D:
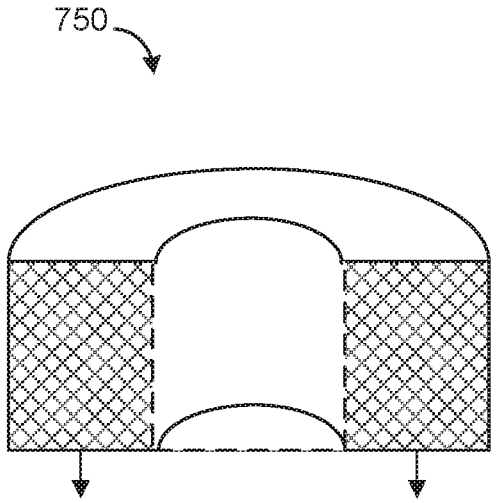
FIG. 7D is an illustration of a rectilinear embodiment, in which the fundamental U-shaped waveform guide has been expanded horizontally to its footprint to generate a wide loudspeaker with the capacity to resonate at the lowest audible frequencies, according to one or more example embodiments.
Figure 7E:
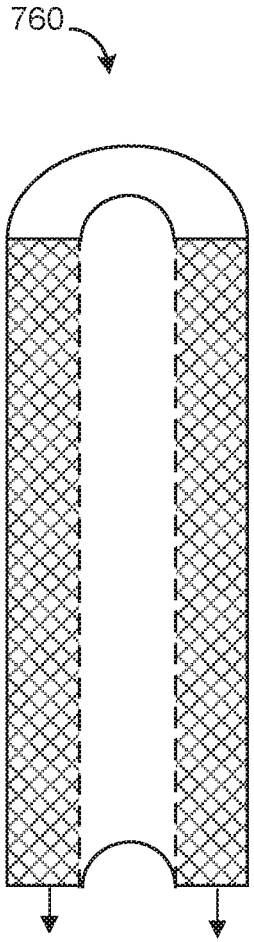
FIG. 7E is an illustration of a rectilinear embodiment, in which the fundamental U-shaped waveform guide has been expanded vertically to its footprint to generate a narrow loudspeaker or a tower speaker with the capacity to resonate at the lowest audible frequencies, according to one or more example embodiments.

FIG. 7D is an illustration of a rectilinear embodiment, in which the fundamental U-shaped waveform guide has been expanded horizontally to its footprint to generate a wide loudspeaker with the capacity to resonate at the lowest audible frequencies. This embodiment can be a single continuous structure, which when stretched along a central axis generates a cuboidal horn, such as the short wide tower 750 shown in FIG. 7D. This rectilinear embodiment can be a single continuous structure, which when stretched along a central axis generates a cuboidal horn 760, such as the long narrow tower shown in FIG. 7E. FIG. 7E is an illustration of a rectilinear embodiment, in which the fundamental U-shaped waveform guide has been expanded vertically to its footprint to generate a narrow loudspeaker or a tower speaker with the capacity to resonate at the lowest audible frequencies. The long tower is designed to function as a loudspeaker or a sound bar. A long tower can be used for sound absorption devices in studios and manufacturing environments because low frequency noise collects in corners. The rectilinear embodiments can be segmented structures that are arranged in a nested wall fashion to form the folded horn. A large, wide loudspeaker design is particularly well-suited for concert sound applications where profound bass levels are required at the lowest audible frequencies. A long tower would work well as loudspeaker shape and for sound absorption devices in studios and manufacturing environments because low frequency noise collects in corners.

FIG. 8A is an illustration of a radial embodiment of a speaker system including multiple, nested bowl-shaped waveform guides creating an acoustic lens composed of nested bowl-shaped folded waveform guides which all can be loaded with one or more drivers, with the "ends" of the bowl-shapes being generally orthogonally planar to the front of the speaker system. Referencing FIG. 8A, the first bowl-shaped horn 800 is generated from a 360-degree rotation of a two-dimensional fundamental U-shape from the rectilinear embodiment to provide a bowl shaped cavity configured to receive a second, smaller bowl. The dedicated driver (not pictured) can be rear-firing into a radial bowl-shaped compression chamber in the back of the first bowl-shaped horn, the mouth of which is a radial slot or an annular ring. A rear-firing driver dedicated to the largest outer bowl shape which defines the first and deepest folded radial waveform guide, would have its internal sound field directed at a smooth spike that points directly at the center of the driver and acts to split the sound pressure evenly in all radial directions in the bowl. This radial splash structure can also be generated by rotating the pinched portion of the U-shaped embodiment through 360 degrees just as the overall shape is obtained from rotation around an axis of symmetry. The quasi-hemispherical bowl folds the wave from the first acoustic driver 180 degrees and distributes the sound wave out of an outer annular opening in the front plane of the device. As with the first folded-horn structure, the second mid-bass driver is housed in a second bowl-shaped enclosure which fits at least partially into the cavity of the first bowl shape and completes the inner boundary for the outer bowl shape. The second mid-bass driver fires into a compression chamber contained in the rear of the second, nested bowl-shaped enclosure and directly towards a radial splash structure analogous to the pinched splash plate in FIGS. 2 and 4 that radially folds the sound waves 180 degrees and distributes the sound pressure evenly out of a second annular opening in the front plane of the device. Again, these surfaces may approximate any of the horn profiles listed above. In one embodiment, the second bowl may slide in and out in relation to the outer, larger shell, for example, enabling the listener to adjust the profile of the second folded horn following manufacture. The terms "bowl" or "plate" should be broadly interpreted to include a bell shape or other similar rounded shapes, symmetrical or asymmetrical.

The bowl-shaped waveform guide can also take on different radial morphologies, and if the bowl is flattened out to be shallower and broader instead of deep with a narrow diameter, then one can construct a series of nested plates or acoustic fins which, like the nested bowls and the nested U-shapes actually functions as an acoustic lens when considered as a whole. The curved plates are slightly curled at their edges so as to create an annular opening which occurs around the perimeter of the silhouette of the device and generally acoustically orthogonal to the front of the apparatus. Note that the silhouette can be arbitrarily drawn to meet spatial demands for installation, as in the chassis of a phone or computer or in car door where space is at a premium. So just as the idealized U-shaped acoustic lens, or waveform guide, or loudspeaker, can be wide and short, as in FIG. 7D, or deep and narrow as in FIG. 7E, similarly, the bowls and/or plates that are generated upon their rotation can assume a range or morphologies. In general, a seminal U-shape undergoes either a stretching or a spinning to generate a distinct symmetrical 3-D morphology with its own unique acoustic profile. In the same way, the size and shape of the plates or fins that are also generated by stretching a seminal U-shape and they can be molded to fit any dimension and overall boundary condition.

Figure 8B:
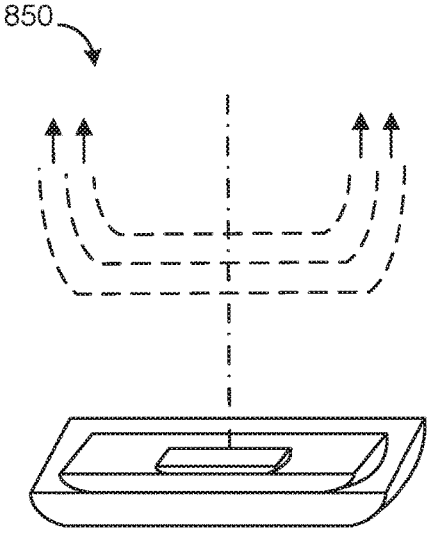
FIG. 8B is an illustration of a rectilinear embodiment of a speaker system including multiple, nested curved folded horns, or acoustic fins, forming an acoustic lens composed of multiple nested flattened out curved plate folded waveform guides which all can be loaded with one or more drivers, with the "ends" or boundary of the curved folded horns being generally orthogonally planar to the front of the speaker system, according to one or more example embodiments.

FIG. 8B is an illustration of a rectilinear embodiment of a speaker system including multiple, nested curved folded horns, or acoustic fins, forming an acoustic lens composed of multiple nested flattened out curved plate folded waveform guides which all can be loaded with one or more drivers, with the "ends" or boundary of the curved folded horns being generally orthogonally planar to the front of the speaker system. Referencing FIG. 8B, the first curved plate forms the back of the enclosure and may or may not contain a dedicated driver. If there is no dedicated driver, then an opening can provide entry into the outermost waveform guide from sound waves originating from a driver contained in a second nested curved plate. This driver can be rear-firing into a curved plate containing a compression chamber in the back of the first curved plate folded-horn structure, the mouth of which is a rectilinear opening around the perimeter or radial or irregular, which is defined by the space between the first outer curved plate and the second nested curved plate. Each curved plate, or acoustic fin, folds the wave from the first or second acoustic driver 180 degrees and distributes the respective sound waves out of an opening in the front plane of the device. As with the first folded-horn structure, the second mid-bass driver is housed in a second curved plate enclosure which fits at least partially into the cavity of the first curved plate and completes the inner boundary for the outer bowl shape. The second mid-bass driver fires into a compression chamber in the rear of the second, curved plate enclosure and directly towards a cavity that folds the sound waves 180 degrees and distributes the sound wave evenly out of a second opening around the perimeter of the front plane of the device. In one embodiment, the second curved plate may slide in and out in relation to the outer curved plate, for example, enabling the listener to adjust the auditory profile of the both the first and the second acoustic fins following manufacture and during use.

Disclosed here are speaker systems including an enclosure having a back and a front defining a front plane, the enclosure adapted to engage with a first acoustic driver, and a plurality of folded horns to output the sound from the first acoustic driver to the front plane. Disclosed here are speaker systems including an enclosure having a back and a front defining a front plane, the enclosure adapted to engage with a first acoustic driver; a first folded horn within the enclosure, the first folded horn configured to output a sound from the first acoustic driver to the front plane; and a second folded horn within the enclosure, the second folded horn configured to output the sound from the first acoustic driver to the front plane. In an embodiment, the second folded horn is at least partially nested within the first folded horn. In an embodiment, a second acoustic driver is engaged with the enclosure.

The front plane of the enclosure can be flat or rectilinear. The front plane of the enclosure is curved and has one or more distinct radii. The first acoustic driver can be a low-range woofer housed in a working volume. The first acoustic driver can be a low-range woofer housed in a bowl-shaped enclosure or a configuration of nested folded horns. The first acoustic driver can be a low-range woofer housed in a cylindrical, conical, or spherical enclosure. The first acoustic driver can be a low-range woofer housed in asymmetrical or symmetrical enclosure created by a mold. The second acoustic driver can be a mid-range woofer. The second acoustic driver can be a low- or mid-range woofer housed in a rectilinear or trapezoidal volume. The second acoustic driver can be a low-range woofer housed in a bowl-shaped enclosure or a configuration of nested curved folded horns. The second acoustic driver can be a low- or mid-range woofer housed in a cylindrical, conical, or spherical enclosure. The second acoustic driver can be a low- or mid-range woofer housed in an asymmetrical or symmetrical enclosure created by a mold.

In an embodiment, the speaker system includes a first folded horn that approximates a first U shape; the second folded horn that approximates a second U shape; and the second U shape is at least partially nested within the first U shape. In an embodiment, the first acoustic driver is a rear-firing driver aimed at a central region within the first U shape such that the output of the first acoustic driver is bifurcated between the two ends of the first U shape. The central region of a U shape can be a compression chamber. In an embodiment, the first acoustic driver can be a rear-firing driver aimed at a splash plate within the enclosure which serves to distribute the output of the first acoustic driver. In another embodiment, the first acoustic driver is a rear-firing driver aimed at a central region within the first bowl shape such that the output of the first acoustic driver exits the system from a flared end of a bowl-shaped enclosure defined by the outer bowl and the first nested bowl. The central region of a bowl-shaped enclosure can be a compression chamber. In another embodiment, the first acoustic driver can be a rear-firing driver aimed at a central region within the first curved plate-shape such that the output of the first acoustic driver exits the system from a rectilinear opening defined by the outer curved plate and the first nested curved plate. The central region of curved plate can be a compression chamber. The first acoustic driver can be a rear-firing driver aimed at a radial splash plate within the enclosure which serves to distribute the output of the first acoustic driver. The first folded horn can be defined at least in part by inner surfaces of one or more walls formed within the enclosure. The second folded horn can be defined at least in part by inner surfaces of one or more walls formed within the enclosure. In certain embodiments, the first acoustic driver, the second acoustic driver, or both, are forward- or rear-firing. The speaker system can include one or more mid- and/or high-frequency drivers or tweeters. The speaker system can include at least one of a loudspeaker, a smart speaker, a laptop speaker, a desktop speaker, a speaker, earphones, earbuds, and headphones.

Also disclosed here are loudspeaker systems. In an embodiment, a loud speaker system includes a cabinet having a back and a front defining a front plane; a first enclosure in the cabinet housing a first acoustic driver forming a first folded horn; a second enclosure in the cabinet housing a second acoustic driver forming a second folded horn. The first and second folded horns have outputs aligned with the front plane of the cabinet. The front plane of the enclosure can be flat or rectilinear. The front of the enclosure can be curved and has one or more distinct radii. The first acoustic driver can be a low-range woofer housed in a rectilinear or trapezoidal volume. The first acoustic driver can be a low-range woofer housed in a cylindrical, conical, or spherical enclosure. The first acoustic driver can be a low-range woofer housed in an asymmetrical or symmetrical enclosure created by a mold. The second acoustic driver can be a mid-range woofer. The second acoustic driver can be a low- or mid-range woofer housed in a rectilinear or trapezoidal volume. The second acoustic driver can be a low- or mid-range woofer housed in a cylindrical, conical, or spherical enclosure. The second acoustic driver can be a low- or mid-range woofer housed in an asymmetrical or symmetrical enclosure created by a mold. In an embodiment of the loudspeaker system includes a first folded horn that approximates a first U shape; a second folded horn that approximates a second U shape. Here, the second U shape is at least partially nested within in first U shape. The first acoustic driver can a rear-firing driver aimed at a central region within the first U shape such that the output of the first acoustic driver is divided between the two ends of the first U shape. The first acoustic driver can be a rear-firing driver aimed at a splash plate within the enclosure which serves to bifurcate the output of the first acoustic driver. The second acoustic driver can be a rear-firing driver aimed at a central region within the second U shape such that the output of the second acoustic driver is divided between the two ends of the second U shape. The first folded horn can have configurable surfaces to approximate different waveform guide geometries. The second folded horn can have configurable surfaces to approximate different waveform guide geometries. The second enclosure can be movable within the first enclosure to vary the geometry of the second folded horn. The back of the cabinet can be vertically chambered. The first folded horn can be defined at least in part by inner surfaces of the cabinet and outer surfaces of the first enclosure. The second folded horn can be defined at least in part by inner surfaces of the first enclosure and outer surfaces of the second enclosure. In certain embodiments, the first enclosure, the second enclosure, or both, are ported. In certain embodiments, the first acoustic driver, the second acoustic driver, or both, are forward- or rear-firing. In an example, the loudspeaker system includes one or more mid- and/or high-frequency drivers or tweeters. In certain embodiments, the loudspeaker system can include one or more active or passive crossovers.

Disclosed here are sound waveform guides that include an enclosure having a back and a front defining a front plane; a first folded horn within the enclosure, the first folded horn configured to output a sound from a first source to the front plane; and a second folded horn within the enclosure, the second folded horn configured to output the sound from the first source to the front plane. The second folded horn can be at least partially nested within the first folded horn. In an embodiment, the first folded horn approximates a first U or bowl shape; the second folded horn approximates a second U or bowl shape; and the second U or bowl shape is at least partially nested within the first U or bowl shape.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The systems and methods described herein, therefore, are well adapted to carry out the objects and attain the ends and advantages mentioned, as well as others inherent therein. While example embodiments of the system and method have been given for purposes of disclosure, numerous changes exist in the details of procedures for accomplishing the desired results. These and other similar modifications may readily suggest themselves to those skilled in the art, and are intended to be encompassed within the spirit of the system and method disclosed herein and the scope of the appended claims.

The invention claimed is:

1. A speaker system, comprising:

an enclosure having a back and a front defining a front plane, the enclosure adapted to engage with a first rear-firing acoustic driver;

a first folded horn within the enclosure, the first folded horn configured to output a sound from the first rear-firing acoustic driver to the front plane; and a second folded horn within the enclosure, the second folded horn configured to output the sound from the first rear-firing acoustic driver to the front plane, wherein the first folded horn and the second folded horn each includes a single 180° fold for directing the sound from the first rear-firing acoustic driver to the front plane of the enclosure.

2. The speaker system of claim 1, wherein the second folded horn is at least partially nested within the first folded horn.

3. The speaker system of claim 1, further comprising:

a second acoustic driver engaged with the enclosure.

4. The speaker system of claim 3, wherein the second acoustic driver is a mid-range woofer.

5. The speaker system of claim 3, wherein the second acoustic driver is a low- or mid-range woofer housed in a rectilinear or trapezoidal volume.

6. The speaker system of claim 3, wherein the second acoustic driver is a low-range woofer housed in a bowl-shaped enclosure or a configuration of nested curved folded horns.

7. The speaker system of claim 3, wherein the second acoustic driver is a low- or mid-range woofer housed in a cylindrical, conical, or spherical enclosure.

8. The speaker system of claim 7, wherein the first acoustic driver is a rear-firing driver aimed at a central region within the first U shape such that the output of the first acoustic driver is bifurcated between the two ends of the first U shape.

9. The speaker system of claim 8, wherein the central region is a compression chamber.

10. The speaker system of claim 3, wherein the second acoustic driver is a low- or mid-range woofer housed in an asymmetrical or symmetrical enclosure created by a mold.

11. The speaker system of claim 3, wherein the first acoustic driver, the second acoustic driver, or both, are forward- or rear-firing.

12. The speaker system of claim 1, wherein the front plane of the enclosure is flat or rectilinear.

13. The speaker system of claim 1, wherein the front plane of the enclosure is curved and has one or more distinct radii.

14. The speaker system of claim 1, wherein the first acoustic driver is a low-range woofer housed in a working volume.

15. The speaker system of claim 1, wherein the first acoustic driver is a low-range woofer housed in a bowl-shaped enclosure or a configuration of nested folded horns.

16. The speaker system of claim 15, wherein the first acoustic driver is a rear-firing driver aimed at a central region within the first bowl shape such that the output of the first acoustic driver exits the system from a flared end of a bowl-shaped enclosure defined by the outer bowl and the first nested bowl.

17. The speaker system of claim 15, wherein the first acoustic driver is a rear-firing driver aimed at a central region within the first curved plate-shape such that the output of the first acoustic driver exits the system from a rectilinear opening defined by the outer curved plate and the first nested curved plate.

18. The speaker system of claim 1, wherein the first acoustic driver is a low-range woofer housed in a cylindrical, conical, or spherical enclosure.

19. The speaker system of claim 1, wherein the first acoustic driver is a low-range woofer housed in asymmetrical or symmetrical enclosure created by a mold.

20. The speaker system of claim 1, wherein:

the first folded horn approximates a first U shape;

the second folded horn approximates a second U shape; and the second U shape is at least partially nested within the first U shape.

21. The speaker system of claim 20, wherein the first acoustic driver is a rear-firing driver aimed at a splash plate within the enclosure which serves to distribute the output of the first acoustic driver.

22. The speaker system of claim 1, wherein the first folded horn is defined at least in part by inner surfaces of one or more walls formed within the enclosure.

23. The speaker system of claim 1, wherein the second folded horn is defined at least in part by inner surfaces of one or more walls formed within the enclosure.

24. The speaker system of claim 1, further comprising one or more mid- and/or high-frequency drivers or tweeters.

25. The speaker system of claim 1, wherein the speaker system comprises at least one of a loudspeaker, a smart speaker, a laptop speaker, a desktop speaker, a speaker, earphones, earbuds, and headphones.

26. A loudspeaker system, comprising:

a cabinet having a back and a front defining a front plane;

a first enclosure in the cabinet housing a first rear-firing acoustic driver forming a first folded horn; and a second enclosure in the cabinet housing a second rear-firing acoustic driver forming a second folded horn, wherein the first and second folded horns have outputs aligned with the front plane of the cabinet, and wherein the first and second folded horns each includes a single 180° fold for directing the sound from the first and second rear-firing acoustic drivers, respectively, to the front plane of the cabinet.

27. The loudspeaker system of claim 26, wherein the front plane of the enclosure is flat or rectilinear.

28. The loudspeaker system of claim 26, wherein the front of the enclosure is curved and has one or more distinct radii.

29. The loudspeaker system of claim 26, wherein the first acoustic driver is a low-range woofer housed in a rectilinear or trapezoidal volume.

30. The loudspeaker system of claim 26, wherein the first acoustic driver is a low-range woofer housed in a cylindrical, conical, or spherical enclosure.

31. The loudspeaker system of claim 26, wherein the first acoustic driver is a low-range woofer housed in an asymmetrical or symmetrical enclosure created by a mold.

32. The loudspeaker system of claim 26, wherein the second acoustic driver is a mid-range woofer.

33. The loudspeaker system of claim 26, wherein the second acoustic driver is a low- or mid-range woofer housed in a rectilinear or trapezoidal volume.

34. The loudspeaker system of claim 26, wherein the second acoustic driver is a low- or mid-range woofer housed in a cylindrical, conical, or spherical enclosure.

35. The loudspeaker system of claim 26, wherein the second acoustic driver is a low- or mid-range woofer housed in an asymmetrical or symmetrical enclosure created by a mold.

36. The loudspeaker system of claim 26, wherein:

the first folded horn approximates a first U shape;

the second folded horn approximates a second U shape; and the second U shape is at least partially nested within in first U shape.

37. The loudspeaker system of claim 36, wherein the first acoustic driver is a rear-firing driver aimed at a central region within the first U shape such that the output of the first acoustic driver is divided between the two ends of the first U shape.

38. The loudspeaker system of claim 36, wherein the first acoustic driver is a rear-firing driver aimed at a splash plate within the enclosure which serves to bifurcate the output of the first acoustic driver.

39. The loudspeaker system of claim 36, wherein the second acoustic driver is a rear-firing driver aimed at a central region within the second U shape such that the output of the second acoustic driver is divided between the two ends of the second U shape.

40. The loudspeaker system of claim 26, wherein first folded horn has configurable surfaces to approximate different waveform guide geometries.

41. The loudspeaker system of claim 26, wherein second folded horn has configurable surfaces to approximate different waveform guide geometries.

42. The loudspeaker system of claim 26, wherein the second enclosure is movable within the first enclosure to vary the geometry of the second folded horn.

43. The loudspeaker system of claim 26, wherein the back of the cabinet is vertically chambered.

44. The loudspeaker system of claim 26, wherein the first folded horn is defined at least in part by inner surfaces of the cabinet and outer surfaces of the first enclosure.

45. The loudspeaker system of claim 26, wherein the second folded horn is defined at least in part by inner surfaces of the first enclosure and outer surfaces of the second enclosure.

46. The loudspeaker system of claim 26, wherein the first enclosure, the second enclosure, or both, are ported.

47. The loudspeaker system of claim 26, wherein the first acoustic driver, the second acoustic driver, or both, are forward- or rear-firing.

48. The loudspeaker system of claim 26, further including one or more mid- and/or high-frequency drivers or tweeters.

49. The loudspeaker system of claim 26, further including one or more active or passive crossovers.

50. A sound waveform guide, comprising:

an enclosure having a back and a front defining a front plane;

a first folded horn within the enclosure, the first folded horn configured to output a sound from a first rear-firing source to the front plane; and a second folded horn within the enclosure, the second folded horn configured to output the sound from the first rear-firing source to the front plane, wherein the first folded horn and the second folded horn each includes a single 180° fold for directing the sound from the first rear-firing source to the front of the enclosure.

51. The sound waveform guide of claim 50, wherein the first folded horn is at least partially nested within the second folded horn.

52. The sound waveform guide of claim 50, wherein:

the first folded horn approximates a first U or bowl shape;

the second folded horn approximates a second U or bowl shape; and the second U or bowl shape is at least partially nested within the first U or bowl shape.

* * * * *